US005997348A

United States Patent [19]

Shepherd

[11] Patent Number: 5,997,348

[45] Date of Patent: Dec. 7, 1999

[54] ELECTRICAL ASSEMBLY WITH GROUNDING STRIP CONNECTING CABLE SCREENS

[75] Inventor: Brian Shepherd, Wendover, United Kingdom

[73] Assignee: Smiths Industries Public Limited Company, London, United Kingdom

[21] Appl. No.: 09/086,538

[22] Filed: May 29, 1998

[30] Foreign Application Priority Data

Jun. 17, 1997 [GB] United Kingdom ..... 9712457

[51] Int. Cl.[6] ..... H01R 17/06

[52] U.S. Cl. ..... 439/579

[58] Field of Search ..... 439/579, 610, 439/98

[56] References Cited

U.S. PATENT DOCUMENTS

| | | | |
|---|---|---|---|
| 4,558,918 | 12/1985 | Shores | 439/579 |
| 4,790,775 | 12/1988 | David | 439/579 |
| 5,102,344 | 4/1992 | Tadokoro et al. | 439/98 |
| 5,618,202 | 4/1997 | Okuyama et al. | 439/579 |
| 5,823,825 | 10/1998 | Murphy | 439/610 |

FOREIGN PATENT DOCUMENTS

| | | |
|---|---|---|
| 0 326 350 | 8/1989 | European Pat. Off. . |
| 0 340 327 | 11/1989 | European Pat. Off. . |
| 0620616A1 | 11/1994 | European Pat. Off. . |
| 0 736 931 | 10/1996 | European Pat. Off. . |
| 0 753 907 | 1/1997 | European Pat. Off. . |
| 0793309A2 | 9/1997 | European Pat. Off. . |

*Primary Examiner*—Paula Bradley
*Assistant Examiner*—Tho Dac Ta
*Attorney, Agent, or Firm*—Pollock, Vande Sande & Amernick

[57] ABSTRACT

An electrical connector has an outer metal shell containing a mounting block with columns and rows of mounting apertures. Some of the columns of apertures support electrical sockets; others support a grounding strip. The grounding strip makes connection at either end with the outer shell and has sockets extending in apertures in the block. Cables with two wires in a screening sleeve are connected with the connector by pins mounted at the ends of the wires and the screening sleeve. The pins on the screening sleeve are plugged into sockets on the grounding strip; those on the wires are plugged into sockets in the mounting block on either side of the grounding strip. A conductive gland is clamped about the screening sleeves where they enter the shell to form a second ground path

13 Claims, 2 Drawing Sheets

ELECTRICAL ASSEMBLY WITH GROUNDING STRIP CONNECTING CABLE SCREENS

BACKGROUND OF THE INVENTION

This invention relates to electrical connection.

The invention is more particularly concerned with electrical connection to the screening sheath of an electrical cable, such as where the cable is connected to an electrical connector.

In electrical connectors having many contacts, it can be very difficult to provide effective termination of the screening sheaths on the individual cables to the connector ground body because of the limited space. The interconnection between the screening sheaths and the connector body should preferably have a low inductance and impedance at the frequencies at which the connector is used.

SUMMARY OF THE INVENTION

It is an object of the present invention to provide an improved electrical connection of a screening sheath.

According to one aspect of the present invention there is provided an electrical assembly including an electrical component having a mounting block, the mounting block having an array of apertures arranged in rows and columns at least some of which support respective electrical contact elements, the assembly including a grounding strip having a plurality of electrical contact elements arranged on one face of the strip in alignment with apertures in a column on the mounting block, the assembly including a plurality of electrical cables each having at least one electrical wire and a screening sleeve surrounding the wire, the wires being connected with respective contact elements located in the apertures in the block, the screening sleeves being connected with respective ones of the contact elements in the grounding strip, and the grounding strip making electrical connection with a grounding body of the component.

The contact elements in the grounding strip are preferably electrical sockets, the screening, sleeves being terminated with pins engageable in the sockets. The apertures in the mounting block preferably open at both ends on respective faces of the mounting block. Apertures in the mounting block may contain socket elements, the electrical wires in the cables being terminated with pins that engage in one end of the socket elements. The grounding body is preferably an outer shell of the component and the grounding strip may make electrical contact with the shell at least at one end of the strip. The sleeves on the cables are also preferably electrically connected with the shell where they enter the shell and may be electrically connected with the shell by clamping the sleeves with a conductive element. The assembly may include a plurality of grounding strips. The cables may include two wires extending within the same screening sleeve, the wires preferably being connected with contact elements in apertures in the mounting block on either side of the grounding strip.

According to another aspect of the present invention there is provided an electrical connector including an outer electrically-conductive shell, a mounting block within the shell, the mounting block having an array of apertures arranged in rows and columns, the apertures extending through the length of the block and containing respective electrical contact elements, the connector including a grounding strip having a plurality of electrical contact elements arranged on one face of the strip in alignment with apertures in a column on the rear face of the mounting block, the grounding strip making electrical connection with the shell so that electrical connection can be made with a plurality of electrical cables of the kind having at least one electrical wire and a screening sleeve surrounding the wire by connecting the wires with respective contact elements located in the apertures in the block and connecting the screening sleeves with respective ones of the contact elements in the strip.

An electrical connector assembly of a connector and cables, according to the present invention will now be described, by way of example, with reference to the accompanying drawings.

DETAILED DESCRIPTION OF THE PREFERRED EMBODIMENT

Figure 1:
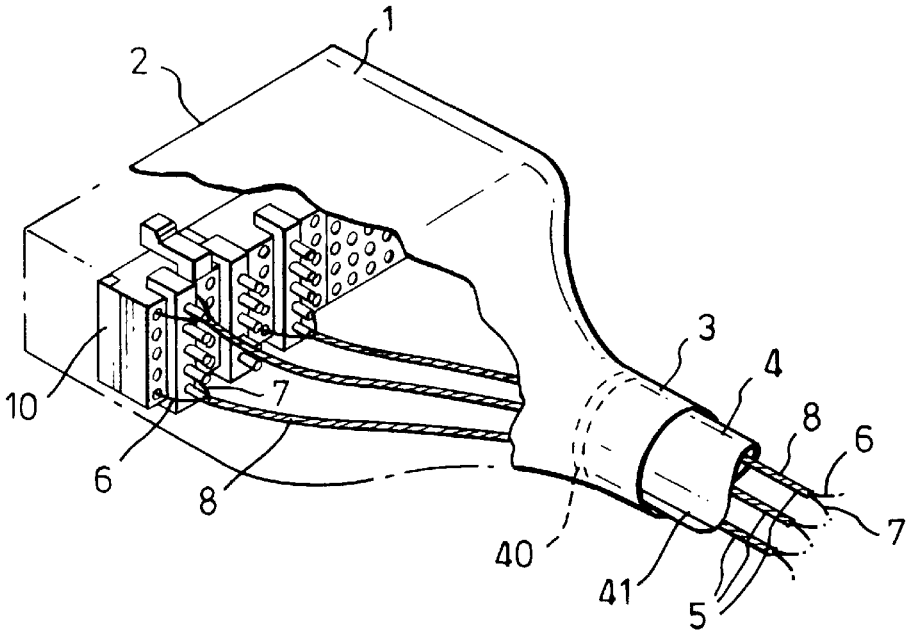
FIG. 1 is a partly cut-away perspective view of the connector.
Figure 2:
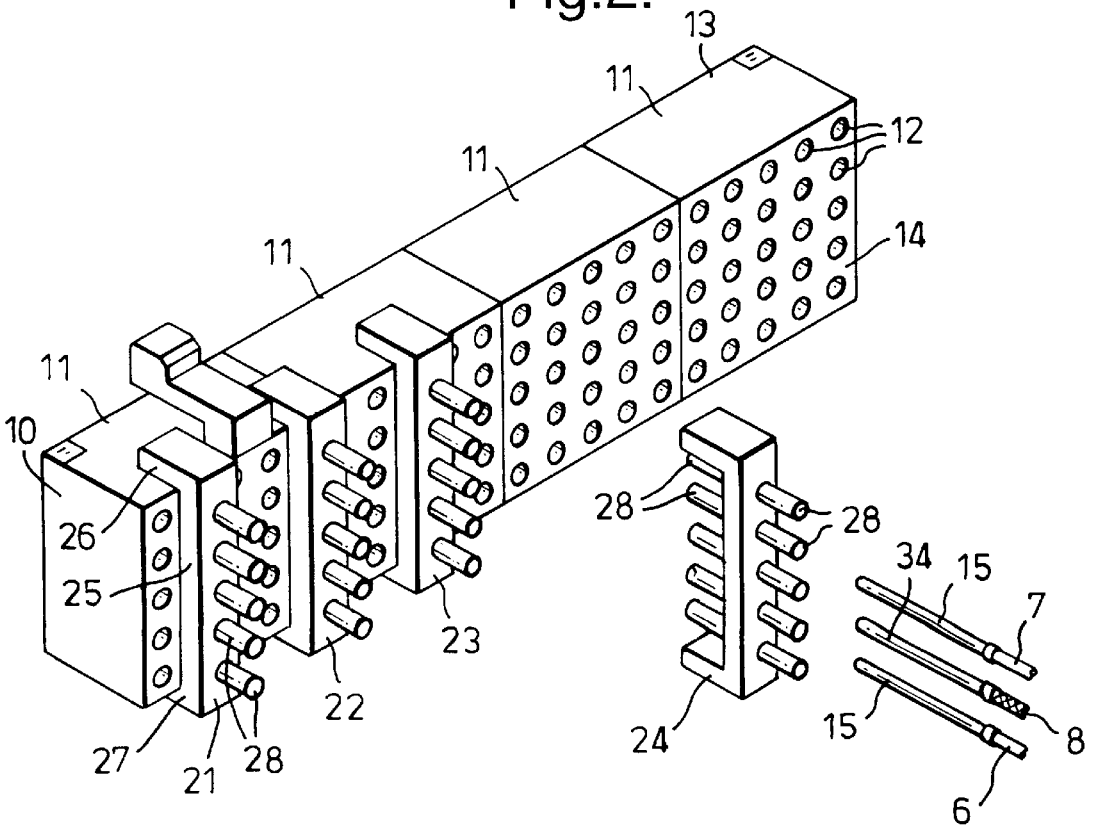
FIG. 2 is a perspective view of a part of the connector to a larger scale.
Figure 3:
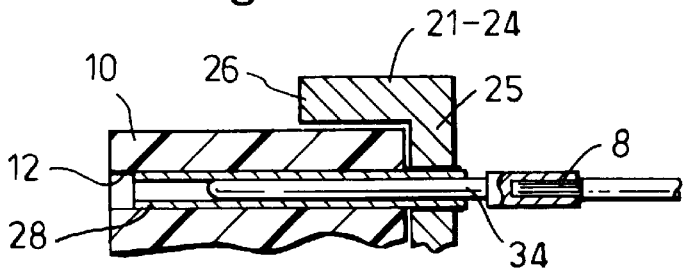
FIG. 3 is a sectional side elevation view of a part of the connector to a larger scale.
Figure 4:
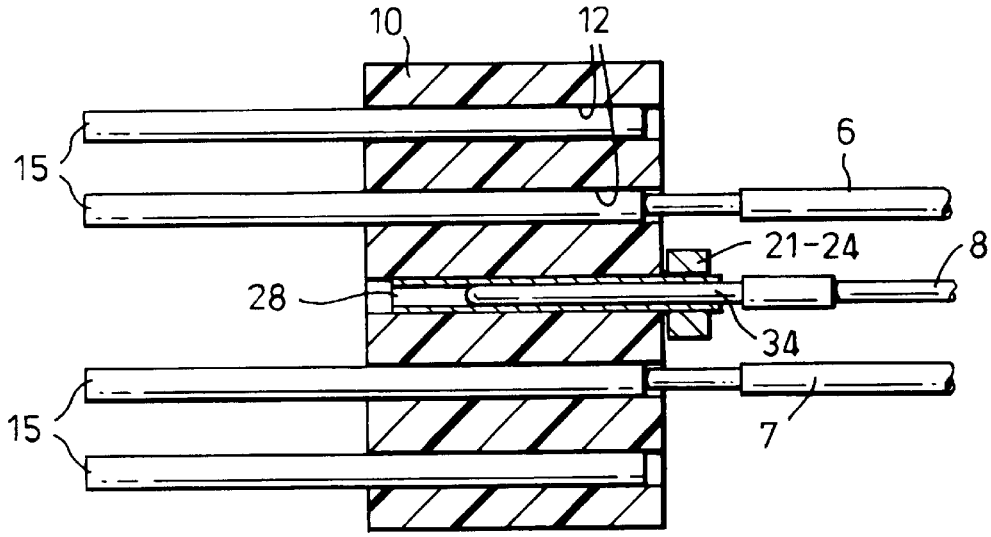
FIG. 4 is a plan view of the part shown in FIG. 3.
Figure 5:
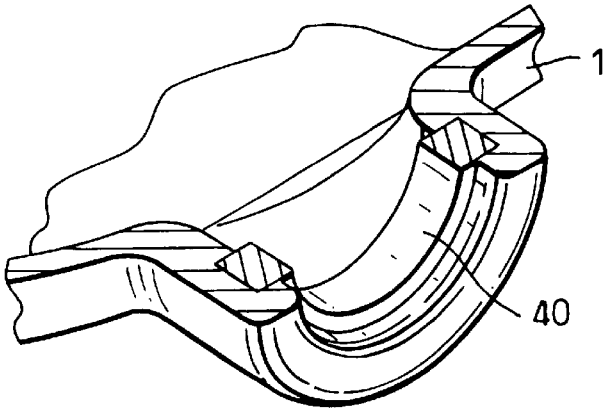
FIG. 5 is a perspective view of another part of the connector.

The connector has an outer metal shell 1 of generally rectangular shape at its forward end 2, which tapers to a cylindrical shape at its rear end 3. The forward end 2 of the connector is open and is adapted to make a mating, push fit with a cooperating connector, not shown. The rear end 3 of the connector is clamped about a cable assembly 4 of several screened electrical cables 5 (only three of which are shown), each of which comprises a twisted pair of two insulated wires 6 and 7 extending within an outer screening sleeve 8 of braided wire.

At its forward end 2 the connector has a rectangular mounting block assembly 10 formed from four square blocks 11 of an electrically-insulative material, such as a plastics. Each block 11 has an orthogonal array of five-by-five apertures 12, arranged in rows and columns making a total of twenty columns across the width of the block assembly 10. It will be appreciated that different connectors will have different numbers and arrangements of apertures. The apertures 12 are open on both the front face 13 and rear face 14 of the block, each aperture supporting a respective contact element 15. In the present example, the majority of the contact elements 15 are sockets inserted into, and removable from, the rear face of the block assembly 10, the rear end of the sockets being crimped to individual wires 6 and 7 in the cable assembly 4. The forward ends of the socket elements 15 project from the front surface 13 of the block assembly 10.

The block assembly 10 supports seven (ground strips, only four of which 21 to 24 are shown. Each strip 21 to 24 has a vertical, rectangular bar 25 of a metal, or other conductive material, with a forwardly projecting finger 26 and 27 at its upper and lower end, which engage the upper and lower edges of the block assembly 10. Each ground strip 21 to 24 has five contact elements 28 in the form of sockets, which project forwardly from the strip and extend within respective apertures 12 in one column, these apertures not containing socket elements 15. The sockets 28 are soldered into the ground strip 21 to 24 and are open at their rear end to receive a male contact pin. In this way, the contact elements 28 in a column are electrically interconnected by the metal bar 25 and are also electrically connected with the shell 1 of the connector, which engages the fingers 26 and 27 where they overlap the edges of the block assembly 10, so that the contact elements 28 are grounded. The seven grounding strips 21 to 24 are spaced along the block assembly 10, being mounted in the second, fifth, eighth, eleventh, fourteenth, seventeenth and twentieth columns of the apertures 12.

At their forward ends, the two wires 6 and 7 of each cable 5 arc terminated within the shell 1 of the connector in respective ones of the socket elements 15, which are poked home into the apertures 12 in the connector block assembly 10. The screening sleeve 8 is terminated by a contact pin 34 adapted to mate in a socket 28 on the grounding strip 21 to 24. The wires 6 and 7 are preferably led out on either side of the screening sleeve 8 so that their ends are located on opposite sides of the screening pin 34. Each of the cables 5 is connected to the mounting block assembly 10 by inserting the screening contact pin 34 in a socket element 28 on one of the grounding strips 21 to 24, and by inserting the socket element 15 on one wire 6 into an aperture 12 in the same row in an adjacent column. The socket element 15 of the other wire 7 is inserted into an aperture 12 in the same row on the opposite side of the grounding strip 21 to 24. Thus, for example, the screening pin 34 of one cable 5 is connected to the top contact 28 of the left-hand grounding strip 21 plugged into the second column. The contact element 15 on one wire 6 of the cable 5 is inserted in the top aperture of the first column, the contact element on the other wire 7 being inserted in the top aperture of the third column. With the grounding strip plugged into the right-hand column, the contacts 15 on the wires 6 and 7 can only be inserted in the apertures 12 in the adjacent left-hand row, so only two twisted-pair cables could be connected to this strip. In many connectors, however, there may be a mixture of different cables within one cable assembly, some of which may not be screened or some of which may be of the single-wire coaxial type. It may not, therefore, be necessary for the connector to have a grounding strip 21 to 24 associated with every group of three columns.

The screening sleeves 8 of the cables 5 are also grounded at a rear location where they enter the connector shell 1, by means of a two-part annular conductive element 40 clamped about the entire circumference of the outside of the bundle of cables. The conductive element may be an EMC conductive elastomer or a knitmesh gland, which also provides strain relief for the wires. Although the conductive element 40 will only make direct contact the outer ones of the cables 5 in the bundle, it will make electrical contact with the inner cables via the screening sleeves 8 of the outer cables contacted by the inner cables. An additional strain relief clamp may be used to the rear of the conductive clamp 40, to engage an outer insulative sleeve 41 of the cable assembly 4.

The arrangement of the present invention has the advantage that individual cables can be easily disconnected from the connector, such as for repair, without disturbing the grounding connection of the other cables. The length of the ground jumper connections, that is the length of screening sleeve separated from the two wires, can be very short, thereby giving it a relatively low inductance. The ground impedance at high frequencies is further reduced by the connection made with the screening sleeves where they enter the connector, at its rear end.

It will be appreciated that the invention could also be used with single-wire or multiple-wire screened cables and that other forms of connection could be used between the wires, screening sleeve and the contact elements and grounding strip. The invention could be used with other electrical components, instead of connectors, such as, for example an electrical feedthrough into a housing.

What we claim is:

1. An electrical assembly comprising: an electrical component, said electrical component including a mounting block, and said mounting block having a rear end face and an array of apertures arranged in rows and columns on said rear end face; a plurality of electric contact elements supported in at least some of said apertures; a grounding body; a grounding strip mounted on said rear end face of said block, said grounding strip having a plurality of electrical contact elements arranged on one face of said strip, each said contact element being axially aligned with a respective one of said apertures in a column on said mounting block; a plurality of electrical cables, each said cable having at least one electrical wire and a screening sleeve surrounding said wire; a connection of said wires with respective ones of said contact elements in said apertures in said block; a connection of said screening sleeves with respective ones of said contact elements in said grounding strip; and an electrical connection of said grounding strip with said grounding body such that said sleeves are electrically connected with said grounding body via said grounding strip.

2. An assembly according to claim 1, wherein said contact elements in said grounding strip are electrical sockets, wherein said screening sleeves are terminated with pins, and wherein said pins are engageable in said sockets.

3. An assembly according to claim 1, further including a plurality of said grounding strips.

4. An assembly according to claim 1, wherein said apertures in said mounting block open at both ends on respective faces of said mounting block.

5. An assembly according to claim 4, wherein said electrical contact elements in said apertures in said mounting block are socket elements, wherein said electrical wires in said cables are terminated with pins, and wherein said pins engage in one end of said socket elements.

6. An assembly according to claim 1, wherein said grounding body is an outer shell of said component.

7. An assembly according to claim 6, wherein said grounding strip makes electrical contact with said shell at least at one end of said strip.

8. An assembly according to claim 6, wherein said sleeves on said cables are also electrically connected with said shell where they enter said shell.

9. An assembly according to claim 8, wherein said sleeves are electrically connected with said shell by a clamped conductive element.

10. An assembly according to claim 1, wherein said cables each include two wires extending within the same screening sleeve.

11. An assembly according to claim 10, wherein said wires connect with said contact elements in said apertures in said mounting block on either side of said grounding strip.

12. An electrical connector comprising: an outer electrically-conductive shell; a mounting block within said shell, said mounting block having a rear end face and an array of apertures arranged in rows and columns on said rear end face, and said apertures extending through the length of said block; a plurality of electrical contact elements supported in at least some of said apertures; and a grounding strip mounted on said rear end face, said grounding strip having a plurality of electrical contact elements arranged on one face of said strip, each said contact element being axially aligned with a respective one of said apertures in a column on said rear end face of said mounting block, and said grounding strip making electrical connection with said shell such that electrical connection can be made with a plurality of electrical cables of the kind having at least one electrical wire and a screening sleeve surrounding said wire by connecting said wires with respective contact elements located in said apertures in said block and connecting said screening sleeves with respective ones of said contact elements in said strip.

13. An electrical connector assembly comprising: an outer electrically-conductive shell; a mounting block within said shell, said mounting block having a rear end face and an array of apertures arranged in rows and columns on said rear end face, and said apertures extending through the length of said block; a plurality of electrical contact elements supported in at least some of said apertures; a ground strip mounted on said rear end face, said grounding strip having a plurality of electrical contact elements arranged on one face of said strip each said contact element being axially aligned with a respective one of said apertures in a column on said rear end face of said mounting block, and said grounding strip making electrical connection with said shell; a plurality of electrical cables, each said cable having at least one electrical wire and a screening sleeve surrounding said wire; and a connection of said wires with respective ones of said contact elements in said apertures in said block; a connection of said screening sleeves with respective ones of said contact elements in said grounding strip such that said sleeves are electrically connected with said shell via said grounding strip.

* * * * *